United States Patent [19]

Raymond et al.

[11] 3,999,413

[45] Dec. 28, 1976

[54] LOCK ASSEMBLY

[76] Inventors: James W. Raymond, 300 Avenida Cumbre, Newport Beach, Calif. 92660; James A. Millett, 18143 Firestone Court, Fountain Valley, Calif. 92708

[22] Filed: Jan. 12, 1976

[21] Appl. No.: 648,176

Related U.S. Application Data

[63] Continuation-in-part of Ser. No. 546,078, Jan. 31, 1975, abandoned.

[52] U.S. Cl. ..... 70/364 R; 70/377; 70/419

[51] Int. Cl.[2] ..... E05B 29/02

[58] Field of Search ..... 70/364 R, 376, 377, 70/382, 383, 384, 419, 421, 375

[56] References Cited

UNITED STATES PATENTS

| | | | |
|---|---|---|---|
| 2,895,323 | 7/1959 | Kennedy | 70/383 |
| 3,722,241 | 3/1973 | Sussina | 70/364 R |

*Primary Examiner*—Robert L. Wolfe
*Attorney, Agent, or Firm*—Keith D. Beecher

[57] ABSTRACT

An improved lock assembly of the wafer tumbler type is provided which includes a plurality of wafer-type tumblers mounted in a cylindrical plug or carrier at spaced positions along the axis of the carrier. The tumblers are slidable radially in the carrier to project beyond the carrier into restricted annular pockets in the inner surface of the housing, so as to hold the lock in a locked condition. Only when the proper key is inserted into the plug are all the tumblers drawn within the confines of the plug by the key, allowing the key to turn the plug and to operate the latch or bolt controlled by the lock. The lock of the invention is constructed so that each tumbler is of a two-piece construction to include a key-follower member which may be engaged with the corresponding tumbler at a selected position along its length, with the key followers assuming different positions with respect to the corresponding tumblers, so that only when a particular key is inserted into the plug, will all the tumblers be drawn within the confines of the plug, allowing the plug to be turned to the unlocking position. The key followers are held in engagement with the respective tumblers during normal operation of the lock. However, the plug can be turned to a re-setting position by the particular key, at which position the followers are released. Then, a new key may be inserted into the lock to cause the key followers to assume different relative positions with respect to the various tumblers in conformity with the new key. Thereafter, when the plug is turned back to the normal operating position, the key followers are locked into engagement with the tumblers at the new position, and the lock is then conditioned for operation with the new key, instead of the former key. Means is provided to prevent the plug from being turned back from its reset position to its normal operating position unless the key is fully inserted into the lock, to prevent partial settings of the key followers. The lock also includes a pick bar which engages the tumblers whenever the plug is turned from a reference position to prevent movement of the tumblers at any angular position of the plug except the reference position, so that the lock is rendered virtually pick-proof.

16 Claims, 9 Drawing Figures

FIG I
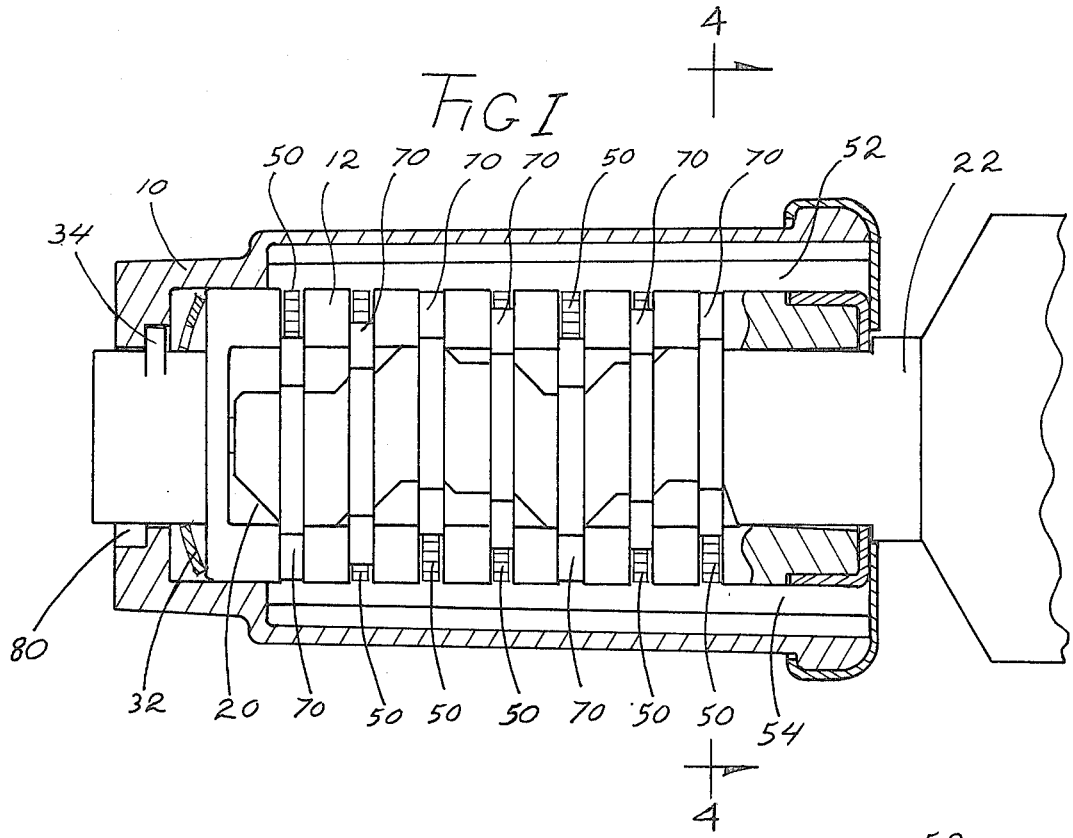
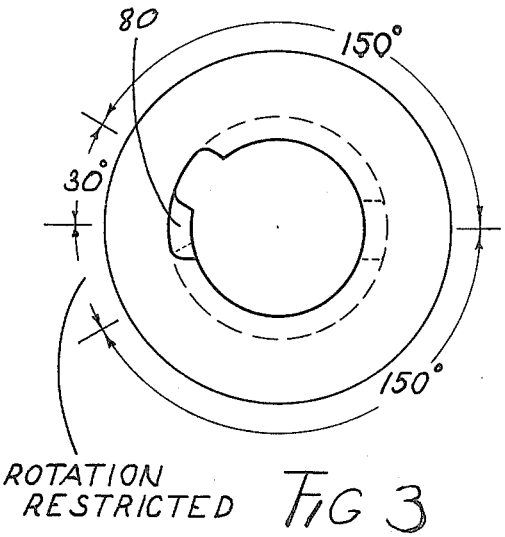
FIG 3
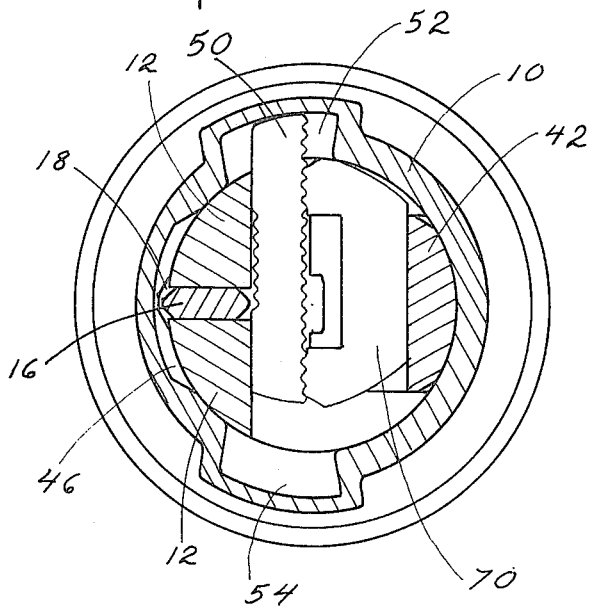
FIG 4

NORMAL OPERATING POSITION

RESET POSITION

LOCK ASSEMBLY

This application is a continuation-in-part of Copending application Ser. No. 546,078 which was filed Jan. 31, 1975 and now abandoned.

BACKGROUND OF THE INVENTION

Locks have remained essentially unchanged in their basic concept for many years. Specifically, each lock in the prior art is usually manufactured to fit a certain key, and each lock may be operated only by that key, and never by a different key. In other words, the internal mechanism of the usual prior art lock is configured to fit a particular key only, and cannot be changed to match up with other keys unless the lock is taken apart and reset by a locksmith.

Attempts have been made in the prior art to provide locks which are more flexible than the usual type of prior art lock described in the preceding paragraph, and which may be set from time-to-time to operate with different keys. The present invention is concerned with such a lock, and a feature of the invention is the provision of an eminently simple lock which can be re-set at will to receive a different key, without the need for any special tools, and merely by turning the lock by the current key to a re-set position, withdrawing the current key, inserting the new key, and turning the lock back to its normal operating position by the new key.

The lock to be described also has an anti-pick feature in the form of a pick bar which engages the tumblers of the lock whenever the plug or carrier is turned from the reference position. The pick bar prevents movement of the tumblers unless the lock is in its reference position. This means that unless the proper key is inserted into the lock, initially to move the tumblers to their proper positions to permit the lock to be turned from the reference position and unlocked, no unlocking operation is possible; because the tumblers are immediately locked in their relative positions as set by the inserted key, upon an initial turning of the lock by the key from the reference position.

The lock of the invention finds particular utility for automotive purposes, as well as for use in conjunction with desks, file cabinets, and the like. However, it will become apparent as the description proceeds, that the lock has general utility wherever locks are used. It will also become apparent as the description proceeds, that the lock of the invention can be made simply, economically, and on a mass production basis, because each lock is exactly the same as all the others, and because each lock is composed of a minimum of operating components. The use of the lock of the present invention permits a person to purchase as many keys as desired for his lock, and to change the lock at will, without the need for any extraneous tools, so that it will operate with a different key, instead of the current key.

If the current key is lost, or stolen, the owner can use a duplicate of the current key to set the lock to a re-settable condition, and can re-set the lock to match an entirely different key, so that the original keys are no longer effective to operate the lock. Moreover, a person can set all his locks to fit a single key, so that but one key need be carried for home, car, office, and so on. In addition, all of the locks may be changed at any time to be operated by a different key, whenever desired, for security or other reasons. The lock of the present invention also has an advantage in that it can be constructed to have approximately the same size as the prior art cylinder locks, so that it can be easily mounted to replace existing locks, without the need for costly retrofit operations.

BRIEF DESCRIPTION OF THE DRAWINGS

FIG. 1 is a side section of one embodiment of the invention, showing a key in place with all the tumblers retracted into the plug;

FIG. 3 is an end view of the lock assembly of FIG. 2, taken essentially along the lines 3—3 of FIG. 2;

FIG. 4 is a sectional view, taken essentially along the lines 4—4 of FIG. 1;

DETAILED DESCRIPTION OF THE ILLUSTRATED EMBODIMENTS

Figure 2:
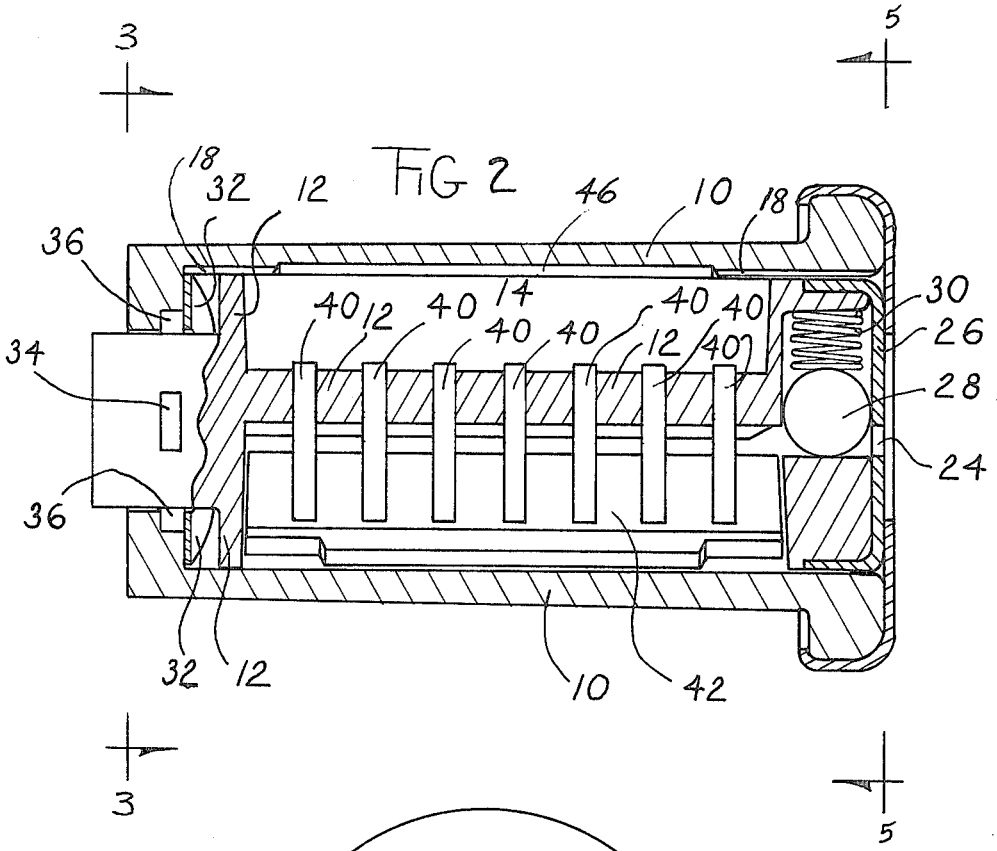
FIG. 2 is a side section like FIG. 1 of one embodiment of the invention, but with the assembly of FIG. 1 turned 90° about its longitudinal axis, and with certain operating components of the lock assembly removed for purposes of clarity.
Figure 5:
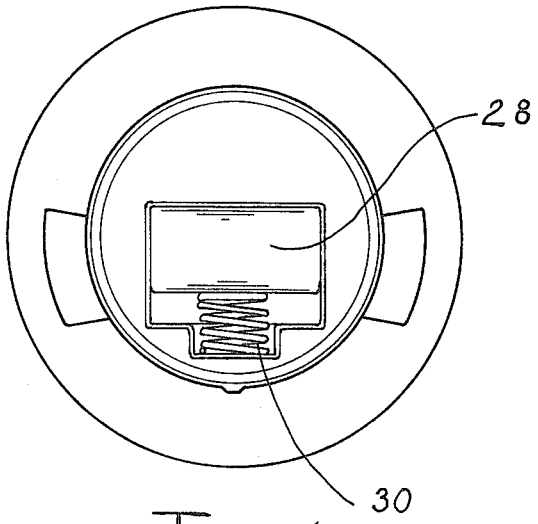
FIG. 5 is an end view taken essentially along the lines 5—5 of FIG. 2, but with the cover removed to reveal certain internal components.

As shown in FIGS. 1 and 2, the lock assembly of the invention includes a cylindrical housing 10 and a carrier or plug 12 rotatably mounted in the housing. The carrier defines an elongated slot 14 (FIG. 2) for receiving a pick bar 16 (FIG. 4). The pick bar 16 has the form of a narrow strip, pointed at each edge, and extending the length of the carrier in the slot 14. The pick bar is radially slidable in the slot 14, and is received in a notch 18 when the carrier is in its reference angular position. The carrier 12 also defines a slot 20 (FIG. 1) extending along its length, for receiving a flat key 22 (FIG. 1). The key is inserted through a keyhole 24 (FIG. 2) in a face plate 26, which is carried on the right-hand end of the carrier 12 in FIG. 2.

A cylindrical-shaped member 28 is supported within the keyhold, and is spring biased by means of a spring 30. The member 28 serves to form an enclosure for the keyhole to keep out snow and ice, and the like, yet to permit the flat key to be inserted through keyhole 24 under the member 28 into the slot 20. The plug 12 is spring biased towards the right-hand end of the housing in FIG. 1 by means of a resilient washer 32. A radially projecting member 34 is mounted on the carrier at the left-hand end of the carrier, and this member rides in an annular groove (FIG. 2) in the housing 10 to limit the rotation of the plug 12, for example, to 150°. However, if the carrier is pushed to the left in FIG. 1 against the spring bias of the washer 32, the projection 34 is freed, so that the carrier may be rotated an additional angular distance to a resetting position, as will be described.

The plug 12 has a series of slots 40 extending radially therethrough, the slots 40 being displaced from one another along the longitudinal axis of the plug. A retainer bar 42 is mounted in the plug 12, and it turns with the plug. When the plug is turned to the re-setting position, by releasing the projection 34, the retainer bar 42 is received in a pocket 46 in the inner surface of the housing 10 (FIG. 2), for reasons to be described. A plurality of elongated strip-like tumblers 50 are received in the slots 40 in the plug, and are slidable in the slots to project beyond the confines of the plug into radially extending diametrically opposite pockets 52 and 54 in the inner surface of the housing 10. So long as the tumblers project into the pockets 52 and 54 rotation of the plug 12 is prevented, so that the lock cannot be unlocked.

As best shown in FIG. 4, each of the tumblers 50 is serrated on both edges. The left-hand edge of each tumbler receives the pick bar 16 when the plug is turned from the reference position, as the pick bar moves out of the notch 18 and is forced into engagement with the various tumblers 50, so that the tumblers are held securely by the pick bar in the radial positions they occupied before the plug rotated from the reference position, and the tumblers thereafter cannot be moved linearly. Therefore, the tumblers may not be moved radially to feel the unlocked position once the plug has been rotated from the reference position, thus the lock is rendered virtually pick-proof.

Each of the tumblers 50 has an associated C-shaped strip-like key follower 70 in its corresponding slot. Each key follower 70 has matching serrations which engage the serrations on the right-hand edge of each of the tumblers 50 when the lock is in its normal operating position, such as shown in FIG. 4, in which the retainer bar 42 holds the key follower 70 firmly in position to engage the corresponding tumblers 50. The key followers 70 are set to engage the corresponding tumblers 50 at different positions along their length. Then, when the proper key is inserted into the lock, as best shown in FIG. 1, all of the tumblers are withdrawn from the pockets 52 and 54, the carrier may be turned for example, through 150° to open the lock. However, further rotation of the plug is prevented by the projection 34.

Now, should the plug 12 be pushed into the casing to the left in FIG. 1 to release the projection 34 into groove 80 in FIG. 3, the plug may then be turned by the key 22 to a position in which the retainer bar 42 is received in the pocket 46 in FIG. 4, so that the key followers 70 are released from engagement with the corresponding tumblers 50. However, all of the tumblers 50 are now displaced from the pockets 52 or 54, so that the tumblers themselves are held by the housing 10 in their fully retracted positions in the plug.

Now, the current key 22 may be removed, and a new key inserted into the lock. The new key, upon insertion into the lock, instead of moving the tumblers 50, will move the key followers 70 to new positions with respect to the respective tumblers, since the tumblers are held against linear movement and the key followers are released because the retainer bar 42 is received in the pocket 46. Now, the plug 12 may be turned back by the new key to its operating position, at which the spring washer 32 will snap the carrier back to the position of FIG. 1. The key followers 70 are now retained in their new positions by the retainer bar 42, as the retainer bar again assumes the angular position of FIG. 4. The lock may now be operated by the new key, which, when inserted, will withdraw the tumblers 50 to their retracted positions of FIG. 1, permitting the lock to be operated.

Figure 6:
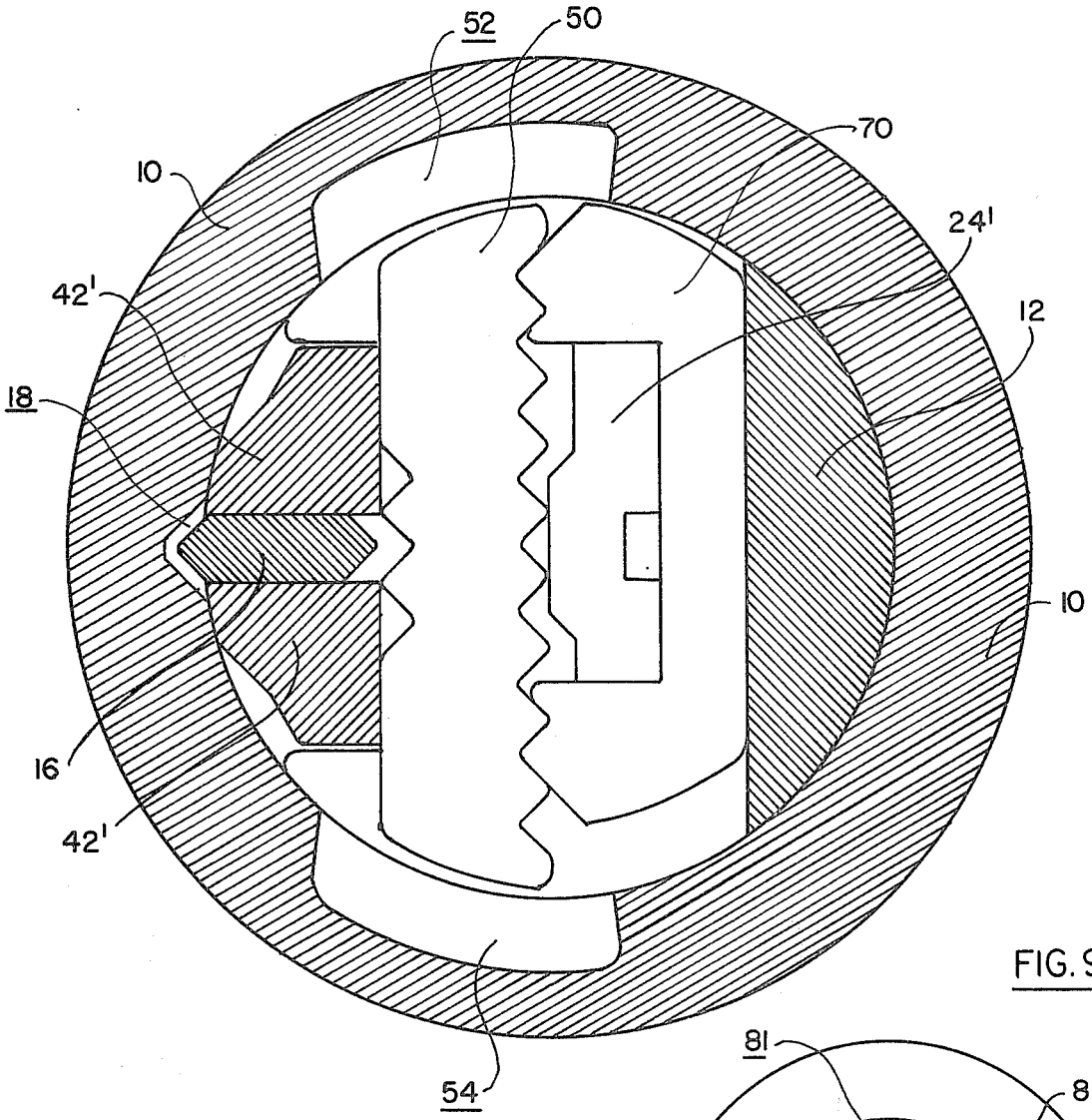
FIG. 6 is a sectional view of a second embodiment taken along the same section line as the representation of FIG. 4.

In the embodiment of FIG. 6, it will be observed that the pocket 46 is eliminated, and the pick bar 16 is mounted in the retainer bar 42', rather than in the plug 12. The retainer bar 42' performs the same function as the retainer bar 42 of the previous embodiment, but has a slightly different configuration to permit it to be received in one of the two pockets 52 or 54 for resetting purposes, rather than in the additional pocket 46 of FIG. 4.

The embodiment of FIG. 6 has certain advantages over the previous embodiment, in that the lock may be set to its resetting position without the need to turn the plug through 180°, as is the case with the previous embodiment. This is advantageous since in some applications, it is infeasible to provide a lock in which the plug must be turned through 180° to achieve its resetting position.

Figure 7:
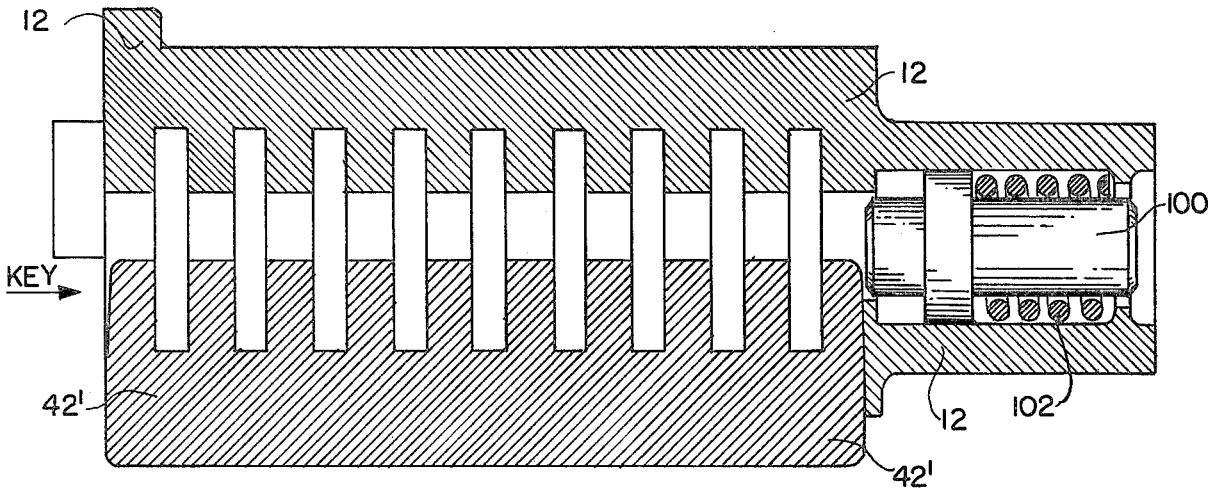
FIGS. 7 and 8 are side sections of certain components of the second embodiment showing the manner in which the plug is retained in its resetting position unless the key is fully inserted into the lock.
Figure 8:
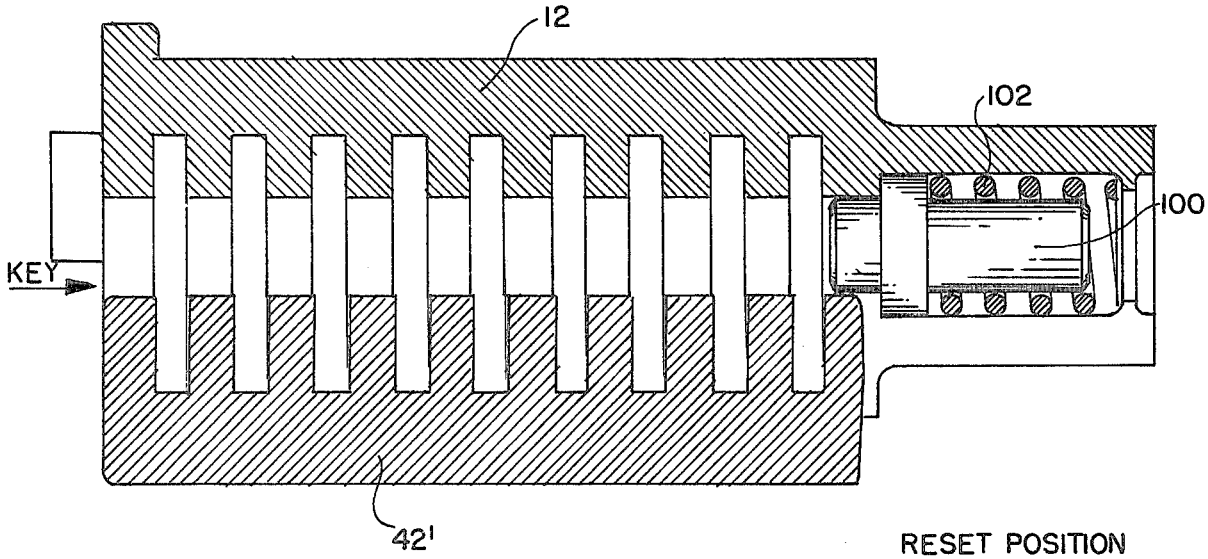

The second embodiment also includes a pin 100, as shown in FIGS. 7 and 8, which is normally biased to the left by a spring 102, or other appropriate resilient means. As illustrated, the spring-loaded pin 100 is mounted in the plug 12 coaxially with its axis of rotation, and during normal operation of the lock, it bears against the end of the retainer 42', as shown in FIG. 7. However, when the plug is turned to a re-setting position in which the retainer is received in one of the pockets 52 or 54, the resulting radial displacement between the retainer and the plug causes the pin 100 to be biased between the two members, as shown in FIG. 8, so that the retainer is held in the pocket, and the plug cannot be turned back to its normal operating angular position.

The pin 100 is released only when the key is inserted all the way into the lock, thereby pushing the pin back to the right to the position shown in FIG. 7. Now, the lock may be turned from its re-setting position to its normal operating position, with the retainer being forced out of the pocket. This pin assures that the lock cannot be returned to its normal operating position unless the key has been fully inserted into the lock, thereby assuring that all the tumblers in the lock have been reset to their new operating positions by the key, before the lock is again placed in operation.

Figure 9:
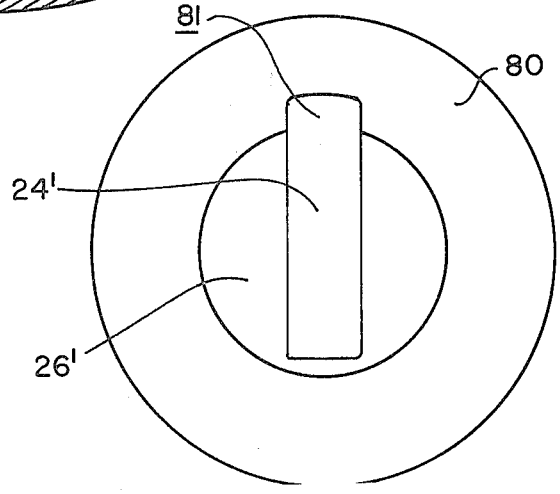
FIG. 9 is a front view of the second embodiment with the face mask in place.

As shown in FIG. 9, a mask 80 is provided at the front of the lock. The mask may have a slot 81 which permits the insertion of the key to operate the lock, the key being equipped with a protuberance which passes through the slot. Then when the lock is turned to a resetting position. The mask prevents the operating key from being withdrawn because the keyway 24' is now turned away from the slot 81. With such a construction, only a special key which does not have the protuberance can be used to reset the lock, because only the special key can be withdrawn when the lock is in the resetting position. As an alternative, a second slot may be provided in the mask 80 angularly displaced 75° from slot 81 to permit the operating key with the protuberance to be withdrawn when the lock is in its resetting position. A spring biased closure may be provided for the second slot which must be opened before the operating key can be removed when the lock is in its resetting position.

It will be observed, that the lock of the present invention is constructed to utilize a minimum of operating components. Yet, the lock has all the advantages of being virtually pick-proof, and being easily adjusted to receive different keys, without the need for extraneous tools.

It will be appreciated that while particular embodiments of the invention have been shown and described, modifications may be made. It is intended in the claims to cover the modifications which come within the spirit and scope of the invention.

What is claimed is:

1. A lock assembly including: a housing having at least one pocket in the inner surface thereof; a latch-controlling carrier plug rotatably mounted in said housing and having a plurality of radially extending slots therein displaced from one another along the longitudinal axis of the plug; a plurality of elongated flat plate-like tumbler members respectively mounted in the slots in said plug and slidable therein for movement into the pocket in said housing to hold the lock assembly in a locked condition; a corresponding plurality of flat plate-like key-follower members respectively mounted in said slots in said carrier in edge engagement with respective ones of said tumbler members in a particular code pattern so that the insertion of a key with a code pattern matching the code pattern of the key-follower members causes the key-follower members to retract all the tumbler members from said pocket, said tumbler members and said key-follower members having serrated edges to provide mutual engagement therebetween; and a retainer bar mounted on said carrier and interposed in said housing between said key-follower members and the inner surface of said housing to hold said key-follower members in engagement with respective ones of said tumbler members during normal operation of the lock, and to release the key-follower members from said tumbler members when the plug is turned to a resetting angular position in said housing in which the retainer bar is received in a pocket in said housing.

2. The lock assembly defined in claim 1, in which said tumbler members are each serrated on both edges, and in which said key-follower members each has a serrated edge to engage one of the serrated edges of the corresponding tumbler members; and which includes a pick bar mounted on said plug to engage the other serrated edge of each of the tumbler members to prevent movement of the tumbler members when the plug is turned from a reference position.

3. The lock assembly defined in claim 2, in which said housing has a notch in the inner surface thereof to receive said pick bar and release the tumbler members from engagement therewith when the plug is in the reference position.

4. The lock assembly defined in claim 1, and which includes stop means mounted on said plug and housing normally to limit angular movement of the plug to prevent the plug from being turned to the re-setting position; and resilient means mounted in the housing and biasing said plug longitudinally from a position in which said stop means is ineffective to a position in which a stop means is effective, so that longitudinal movement of the plug against the resilient means releases the stop means to permit the plug to be turned to the resetting position in which the retainer bar is received in said last-named pocket to release the tumbler members from the key-follower members.

5. A lock assembly including: a housing having at least one pocket in the inner surface thereof; a latch-controlling carrier plug rotatably mounted in said housing and having a plurality of radially extending slots therein displaced from one another along the longitudinal axis of the plug; a plurality of elongated tumbler members respectively mounted in said slots and slidable therein for movement into said pocket to hold the lock assembly in a locked condition; and a corresponding plurality of key-follower members respectively mounted in said slots in engagement with respective ones of said tumbler members in a particular code pattern so that the insertion of a key with a code pattern matching the code pattern of the key-follower members causes the key-follower members to retract all the tumbler members from said pocket; in which said tumbler members are serrated on at least one edge, and which includes a pick bar mounted on said plug to engage the serrated edge of each of the tumbler members to prevent movement of the tumbler members when the carrier is turned from a reference position.

6. The lock assembly defined in claim 1, in which said housing as diametrically opposite first and second pockets in the inner surface thereof; in which the slots in said plug extend through the plug; in which said tumbler members have a flat plate configuration, and in which said key-followers have a flat plate configuration, said tumbler members and said key-follower members being in side engagement with one another in the respective slots; and in which the tumbler members are slidable in the slots for movement into one or the other of the first and second pocket to hold the lock assembly in a locked condition, and in which said key-follower members each has a U-shaped configuration to define a slot for receiving the key.

7. The lock assembly defined in claim 1, in which said plurality of tumbler members are individually serrated on at least one edge, and in which said plurality of key-follower members are individually serrated on at least one edge to engage the serrated edges of the corresponding tumbler members, and in which the members of one of the first and second pluralities are serrated on both edges; and which includes a pick bar mounted on said plug to engage the other serrated edges of the members of said one plurality to prevent movement of the tumbler members and of the key-follower members when the plug is turned from a reference position.

8. The lock assembly defined in claim 6, in which said retainer member is received in one of said first and second pockets when the plug is turned to said re-setting angular position in said housing.

9. The lock assembly defined in claim 1, and which includes locking means for maintaining the retainer member in said last-named pocket to prevent the plug from being turned from said re-setting angular position until the key has been fully inserted into the lock.

10. The lock assembly defined in claim 9, in which said locking means comprises a spring-loaded pin mounted in said plug at one end thereof coaxially with the axis of rotation thereof to be engaged by the key when the key is fully inserted into the lock.

11. The lock assembly defined in claim 1, and which includes a pick bar mounted on said plug to prevent movement of the tumbler members when the plug is turned from a reference position.

12. The lock assembly defined in claim 11, in which said pick bar is mounted in said retainer bar to be radially slidable therein.

13. The lock assembly defined in claim 1, in which said retainer bar is mounted between the tumbler members and the housing.

14. The lock assembly defined in claim 1, and which includes a face plate mounted at one end of the housing and having a keyhole therein, and a spring loaded member mounted in the housing to form an enclosure for the keyhole.

15. The lock assembly defined in claim 1, and which includes a slotted mask mounted over the forward end of the lock assembly to prevent removal of an operating key from the lock assembly when the plug is turned to said resetting angular position in said housing.

16. The lock assembly defined in claim 15, in which the slotted mask has a restrictive means in one of the slots to prevent removal of said operating key from the lock assembly when the plug is turned to said resetting angular position in said housing.

* * * * *